US005855132A

United States Patent [19]

Cozzi

[11] Patent Number: 5,855,132

[45] Date of Patent: Jan. 5, 1999

[54] FLATTENING GROUP IN LEVELLING MACHINES KEPT UNDER TENSION FOR METAL BANDS WITH OPERATIVE ROLLERS OF INCREASING DIAMETER

[75] Inventor: Serafino Cozzi, Giussano, Italy

[73] Assignee: Selema, S.R.L., Giussano, Italy

[21] Appl. No.: 831,620

[22] PCT Filed: Dec. 5, 1994

[86] PCT No.: PCT/IT94/00205

§ 371 Date: Apr. 9, 1997

§ 102(e) Date: Apr. 9, 1997

[87] PCT Pub. No.: WO96/14175

PCT Pub. Date: May 17, 1996

[30] Foreign Application Priority Data

Nov. 8, 1994 [IT] Italy ..... MI94A2259

[51] Int. Cl.[6] ..... B21D 1/05

[52] U.S. Cl. ..... 72/160; 72/205

[58] Field of Search ..... 72/164, 165, 163, 72/160, 162, 205

[56] References Cited

U.S. PATENT DOCUMENTS

| | | | |
|---|---|---|---|
| 2,386,533 | 10/1945 | Yoder | 72/165 |
| 5,097,691 | 3/1992 | Slabowski | 72/165 |

FOREIGN PATENT DOCUMENTS

| | | | |
|---|---|---|---|
| 245917 | 11/1986 | Japan | 72/160 |
| 38721 | 2/1987 | Japan | 72/160 |
| 733771 | 5/1980 | Russian Federation | 72/164 |
| 923667 | 4/1982 | Russian Federation | 72/165 |
| 548639 | 10/1942 | United Kingdom | 72/160 |

*Primary Examiner*—Daniel C. Crane
*Attorney, Agent, or Firm*—Michael J. Striker

[57] ABSTRACT

Flattening group (18) for levelling machine with operative rollers (60–65, 70–74) of increasing diameter.

4 Claims, 4 Drawing Sheets fig. 5
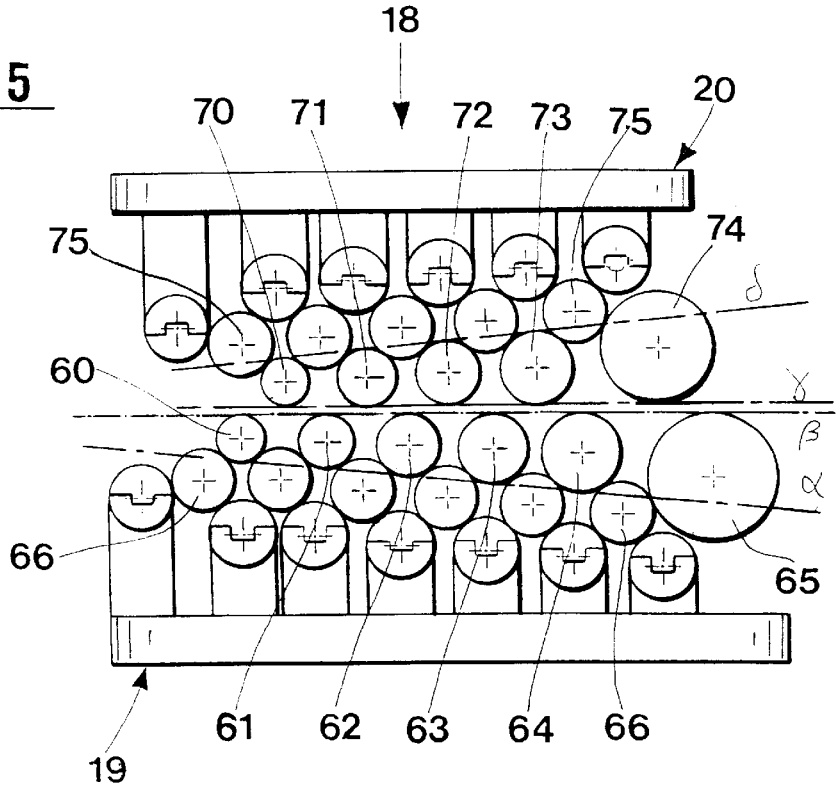
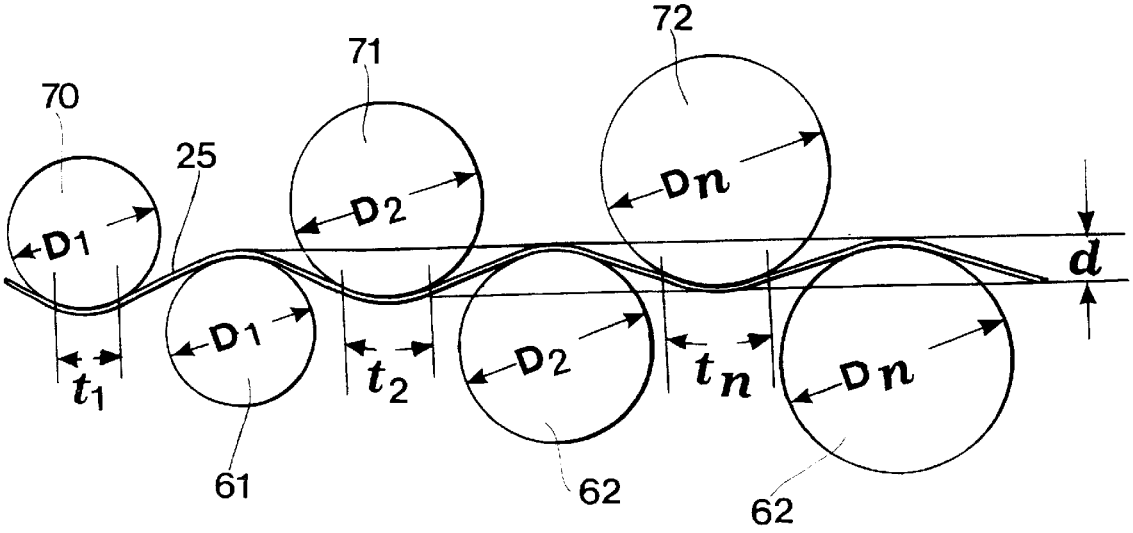
fig. 6

Figure 1:
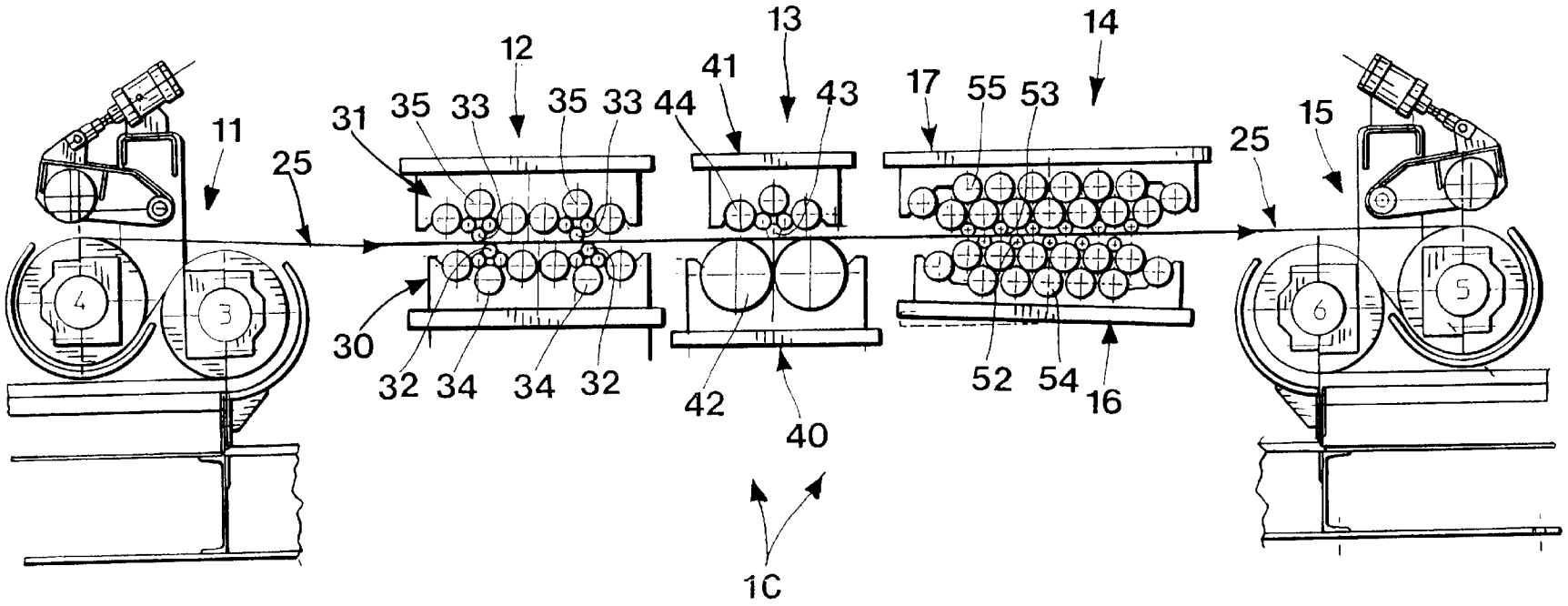

FLATTENING GROUP IN LEVELLING MACHINES KEPT UNDER TENSION FOR METAL BANDS WITH OPERATIVE ROLLERS OF INCREASING DIAMETER

This application is a 371 of PCT/IT94/00205, filed Dec. 5, 1994.

The invention concerns machines used for unfinished or finished metal products to eliminate the effects of bending and warping generally that occur after application of mechanical processes or heat treatment.

The distorsion that is commonly produced in unfinished products arises during the cooling stage that follows the rolling process and causes bending in the plane perpendicular to that to which the minimum moment of inertia in the unfinished product corresponds.

The internal stresses present in laminated metal bands usually originate in some irregularity in the mechanical characteristics of the rolling operation.

During subsequent processes such as shearing, cutting and others, these internal tensions cause warping and in particular a lack of flatness.

Such defects are chiefly due to differences in length of the metal fibres as well as to internal residual and opposing stresses.

To achieve flatness all the metal fibres must be of the same length, creating new internal stresses which act against and can overcome the existing ones.

For this purpose machines known as levellers are used.

The levellers for metal bands and long sheets operate by means of a continuous process using transversal rollers which make high working speeds possible.

Cold levelling can with advantage be obtained by applying appropriate traction to the material in a process called stretching.

The operation is known as flattening under tension and is done with a leveller called a tensio-flattener.

This machine comprises a tightening device at the entry, a group of rollers for stretching to yield point, a group for straightening, another group for flattening and a tightening device at the exit.

Tension is set up by the tightening devices at entry and exit, and these keep the band at a constant previously set tension while it is passing through the machine.

Function of the first group is to stretch the material evenly to yield point.

Function of the straightener is to straighten the band that leaves the stretching rollers in a very warped condition.

Function of the flattener is to free the material from its residual stresses.

The operative rollers used for stretching,straightening and flattening are drawn along by passage of the band which produces friction and so moves the rollers.

The operative rollers in turn transmit movement to the supporting rollers whose function is to sustain the operative rollers and prevent any excessive bending.

In the flattening group the operative rollers have a constant diameter and their contact with the band is assured by movement of the lower bed that rises up to the desired position; said lower bed can also be inclined in the direction of band movement in relation to the upper bed.

Flatness is achieved by adjusting the length of time when the band is in contact with the flattening roller.

For a certain band speed this time is obviously a function of the position of operative rollers supported by the lower bed in relation to the operative rollers supported by the upper bed.

The more closely the lower bed approaches the upper one the greater will be the fraction of band that is made to surround, one by one, the upper and lower rollers waving in one direction and in the opposite one.

Since the diameter of these rollers is constant, it is impossible to adjust the time variable independently of the length of band that passes round each roller.

In other words, to obtain a longer period of contact between band and roller, the fraction of band round the rollers must be increased while the radius of curvature of the various waves of band obviously remains unchanged.

Further, adjustment of the machine is left to the discretion of the operator and is limited by the time of bending. When flattening speed is high, band stretching times are therefore short and stretching is not uniform.

The above invention greatly improves performance of the machine achieving unprecedented flattening results as will be explained below.

Subject of the invention is a flattening unit for levelling machines with two opposing beds that support cylindrical idling operative rollers between which passes the band to be flattened.

Diameters of the rollers of one bed or of both, differ.

It is an advantage if the diameters of the rollers increase in relation to the direction of movement of the band to be flattened while being aligned so as to lie externally tangential to the geometrical plane.

The increase in diameters of the aligned rollers is constant and said rollers are therefore externally and internally tangential to the two angular geometrical planes.

The diameter of the last roller, in the direction of band movement, is considerably larger than that of the others that precede it.

Advantageously, the diameters of the rollers of both opposing beds are substantially equal, or the diameters of rollers on the lower bed can be larger than those of the opposite rollers on the upper bed.

It is preferable that diameters of all the operative rollers should be considerably larger than those of the operative rollers on flattening machines at present in use.

Distances between the various rollers of increasing diameter are determined according to said diameters and to the characteristics of the bands to be flattened.

The invention offers evident advantages.

At the present time operators of levelling machines have only one variable available to them and this consists in the possibility of increasing the period of contact between the rollers and the band being flattened but this is connected to the distance between opposing operative rollers; now a second and decisive variable is added, that corresponding to the diameters of the operative rollers.

By the use of rollers whose diameters increase in the direction of the band's forward movement, residual stresses in the band are eased by progressive reduction of curvature so that its configuration approaches the one to be ultimately obtained.

To the variable constituted by band-roller contact, a new one is therefore added, a variable that can be determined with precision and does not depend on the operator's decision.

The quality of band flatness can thus be greatly improved not only compared with that obtainable at present, but also much more easily.

Characteristics and purposes of the invention will be made still clearer by the following example of its execution illustrated by diagrammatically drawn figures.

FIG. 1 The essential parts of a present levelling machine.

Figure 2:
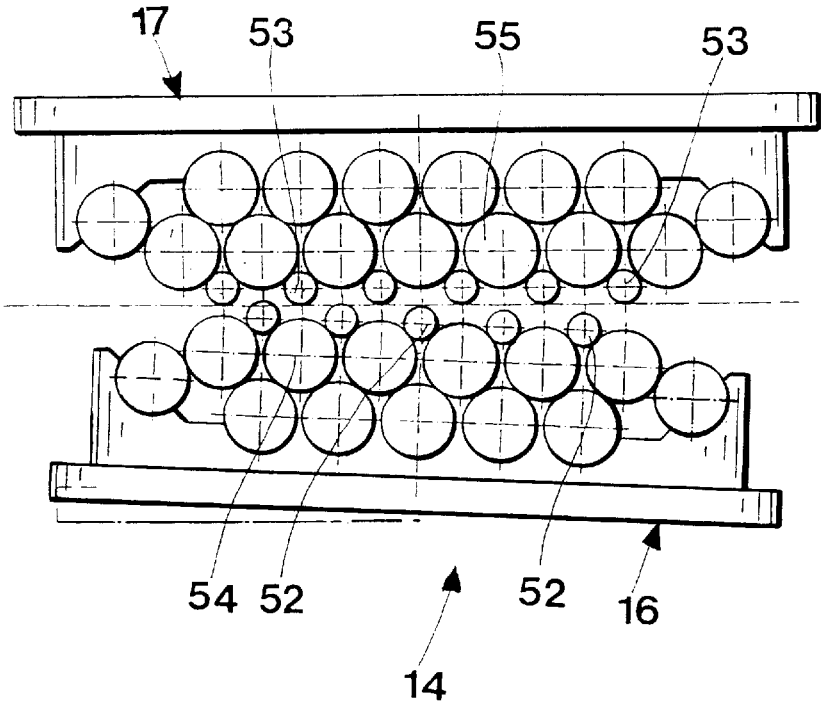

FIG. 2 A set of flattening rollers as at present.

Figure 3:
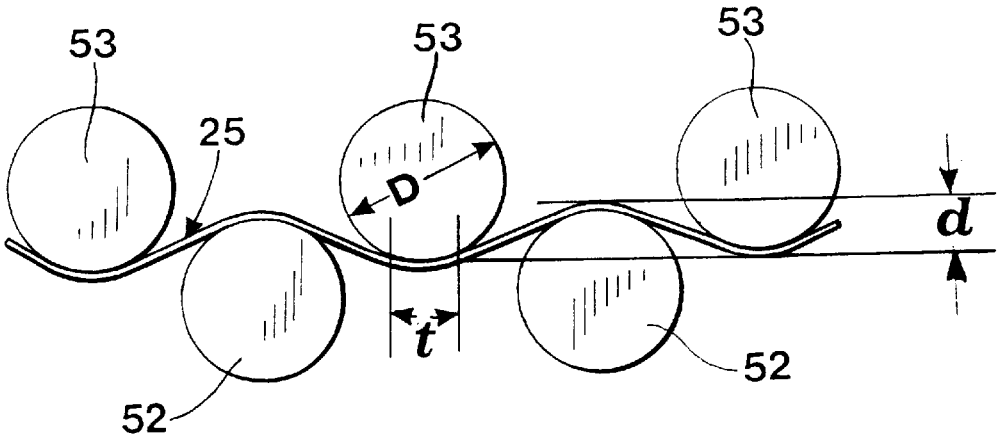

FIG. 3 Diagram to show action of an operative roller on a metal band.

Figure 4:
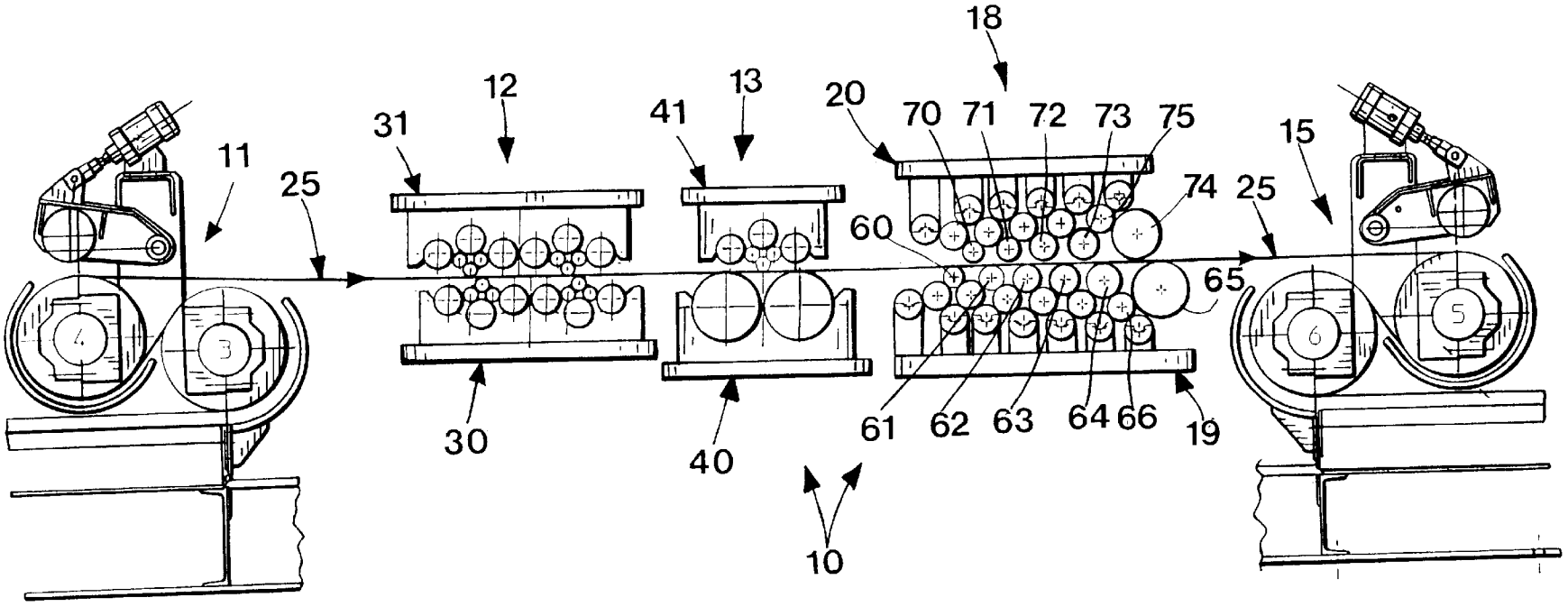

FIG. 4 A levelling machine with a set of the flattening rollers subject of the invention.

FIG. 5 A new set of flattening rollers.

FIG. 6 Diagram to show action on a band of a set of the invented flattening rollers.

The machine 10 substantially consists of the following roller groupings: those to produce tension comprising a tightener 11 at the entry and another tightener 15 at the exit, rollers for stretching to yield point 12, rollers for straightening 13 and those for flattening 14.

The tightener units at entry 11 and at the exit 15 keep the band 25 at a certain constant tension for the whole time it is passing through the machine.

Function of the stretching group 12 is to stretch the material uniformly to yield point, and this group comprises the beds 30 and 31 with their operative rollers 32 and 33 and supporting rollers 34 and 35.

The straightener group 13 comprises the beds 40 and 41 with operative rollers 42 and 43 and supporting rollers 44. The function of these rollers is to straighten the band, which is highly warped when it emerges from the stretching rollers and which has a bend turned backwards towards the last stretching roller, to establish the curve, and reduce internal stresses caused by stretching.

The flattening group 14 removes residual stresses so as to produce a band free from stress and perfectly flat even after cutting.

The operative rollers in the stretching, straightening and flattening groups are put in motion by friction from the band passing through them.

The flattening group 14 is formed of a lower bed 16 and an upper one 17.

The lower bed comprises a set of operative rollers 52 and a set of supporting rollers 54.

The upper bed comprises a set of operative rollers 53 and a set of supporting rollers 55.

Diameter is constant for the operative rollers 52 and 53 on both beds.

Contact between the operative rollers 52, 53 and the band 25 is assured by movement of the lower bed 16 towards the upper bed 17.

The lower bed 16 is also inclinable in the forward direction of the band 25 in relation to the upper bed 17.

As the figures show, diameters are constant for the two sets of operative rollers 52 and 53 in the flattening group.

FIG. 3 gives a diagrammatic illustration of the action of rollers 52 and 53 on the band 25. The length (t) of the arc of contact between rollers and band depends both on the diameter (D) of the rollers and on the distance (d) between the set of rollers 52 on the lower bed 16 and the set of rollers 53 on the upper bed 17.

Obviously, at a certain speed of band movement, the length (t) of the arc corresponds to a certain period of contact between band and rollers.

Since the diameter (D) is obviously fixed, the length (t) of the arc depends on the above distance (d) determined by the operator of the levelling machine.

According to the invention the flattening group of rollers 14 in FIGS. 1 and 2 is replaced by the group 18 shown in FIGS. 4 and 5. The flattening group 18 comprises a lower bed 19 and an upper one 20. The lower bed 19 comprises a set of operative rollers 60–64 whose diameter increases in the forward direction of the band 25. Diameter increase is constant as seen by the geometrical planes indicated by broken lines (α) and (β) in FIG. 5 that form lower (external) and upper (internal) tangents to said set of rollers.

Although the diameter of the end roller 65 is appreciably larger than those of the preceding rollers, it is equally tangential to the plane (α) indicated above.

Said operative rollers are governed by the supporting rollers 66 whose diameter is constant.

The diameters of the operative rollers 70–73 on the upper bed 20 increase in the same way, this increase being constant as shown by the broken lines (α) and (γ) on the geometrical planes tangential to said rollers.

The diameter of the end roller 74 is much larger but said roller is similarly tangential to the broken line (γ).

Said operative rollers 70–74 are governed by the set of supporting rollers 75 of equal diameter.

The diameters of the operative rollers on the lower bed are slightly larger than those of the corresponding operative rollers on the upper bed.

As will be clearly seen in the graphic representation in FIG. 6, the extent (d) of approach between the upper and lower beds being equal, the periods ($t_l$–$t_n$) of contact between the band 25 and rollers 60–65 and 70–74 varies in accordance with the diameters ($D_l$–$D_n$) of said rollers.

Therefore, in addition to availability of the (t) variable, there is also the (D) diameter variable and this can be previously set without depending on the operator's discretion.

I claim:

1. A flattening group for a tensio-flattener with stretching devices at entry and exit to a band to be flattened, the flattening group comprising two opposing beds; idle cylindrical working rollers supported by said beds and arranged so that the band to be flattened slides between and contacts said rollers, said rollers having increasing diameters in relation to a direction of feed of the band, at least three rollers for each bed being externally tangential to a geometrical plane on a side of the rollers that is in contact with said band.

2. A flattening group as defined in claim 1, wherein the rollers have diameters with a constant increase so as to be externally and internally tangential to a corresponding one of said beds on two respectively angled geometrical planes, said internally tangential geometrical plane being on a side of said rollers opposite the side said band contacts said rollers.

3. A flattening group as defined in claim 1, wherein a last roller of a series of the rollers with diameters having a constant increase has a diameter of a value considerably greater than a diameter of a preceding roller, with an increase compared with the preceding roller being between 60% and 80%.

4. A flattening group as defined in claim 1, wherein on each of said beds a distance between said rollers whose diameters show a constant increase is determined as a function of said diameters and as a function of characteristics of the band to be flattened.

* * * * *